United States Patent [19]

Miyazawa

[11] 4,072,139

[45] Feb. 7, 1978

[54] CARBURETOR

[76] Inventor: Kuniaki Miyazawa, 1548, Nishioizumi-cho, Nerimaku, Tokyo, Japan

[21] Appl. No.: 574,813

[22] Filed: May 5, 1975

[30] Foreign Application Priority Data

| | | |
|---|---|---|
| May 24, 1974 | Japan | 49-057912 |
| July 18, 1974 | Japan | 49-081701 |
| July 18, 1974 | Japan | 49-081702 |
| Aug. 27, 1974 | Japan | 49-097574 |
| Mar. 17, 1975 | Japan | 50-031116 |
| May 31, 1974 | Japan | 49-060887 |

[51] Int. Cl.[2] ..... F02M 13/04

[52] U.S. Cl. ..... 123/127; 123/119 LC; 261/23 A; 261/23 R; 261/41 C; 261/41 R; 261/DIG. 74

[58] Field of Search ..... 261/23 A, 23 R, 41 C, 261/41 B, 41 A, 41 R, DIG. 74; 123/127, 119 LC, 119 R

[56] References Cited

U.S. PATENT DOCUMENTS

| | | | |
|---|---|---|---|
| 871,320 | 11/1907 | Bollée | 261/23 A |
| 1,074,574 | 9/1913 | Riotte | 261/41 A |
| 1,277,705 | 9/1918 | Disturnal | 261/23 A |
| 1,614,973 | 1/1927 | Sherrick | 261/41 A |
| 1,816,531 | 7/1931 | Holloway | 261/41 C |
| 1,826,202 | 10/1931 | Cole | 261/41 A |
| 1,887,795 | 11/1932 | Bariquand | 261/41 A |
| 2,034,163 | 3/1936 | Von Hilvety | 261/DIG. 74 |
| 2,783,981 | 5/1957 | Briggs | 261/23 A |

FOREIGN PATENT DOCUMENTS

| | | | |
|---|---|---|---|
| 547,069 | 8/1956 | Italy | 261/23 A |

*Primary Examiner*—Wendell L. Burns

*Attorney, Agent, or Firm*—William D. Hall; Geoffrey R. Myers

[57] ABSTRACT

This carburetor comprises plural cell carburetors which are controlled by a servo controller which controls the internal pressure of the carburetor to maintain the pressure constant by opening the air paths of needed number of the cell carburetors.

Every one of the cell carburetors is either completely opened or almost closed; that is there is no intermediate opening between said two conditions except for special use.

The ratios of air to fuel which is produced in each cell carburetor are predetermined for both the open and almost closed positions.

Needed air and fuel are supplied by a combination of the cell carburetors which are selected from combinations of the cell carburetors to be selected for the working condition of the combustion engine.

54 Claims, 16 Drawing Figures

CARBURETOR

BACKGROUND OF THE INVENTION

The present invention relates to a carburetor, for mixing air with liquid fuel.

At present, the environmental pollution by engine exhaust from automobiles or marine engines has become an object of public concern.

Therefore, many proposals have been made, for example (1), to adopt an electronically controlled gasoline injection system (2), all sorts of improved engines and carburetors, and (3) an after burner adopting some kind of catalyst.

But, the problem remains unsolved.

It is known that we can solve the problem, if we are successful to supply and burn lean mixture of air and gasoline having weight ratio from 17:1 to 19:1, in the combustion engine with high stability.

Due to the fact that the load and speed of an automobile engine undergo frequent and sharp change, prior art carburetors are not efficient under all operating conditions and cause heavy pollution of the air by emitting toxic exhaust gases under some operating conditions.

SUMMARY OF THE INVENTION

It is the first object of the invention to provide a carburetor which is able to supply the required quantity of air and atomized gasoline to a combustion engine in any driving condition or mode.

The second object of the invention is to provide a carburetor which is able to produce a mixture that comprises a uniform and finely atomized, fuel content.

The third object of the invention is to provide a carburetor which is applicable to various types of combustion engines, and is able to reduce the content of harmful constituent of exaust, for example, HC, CO and NOx.

The fourth object of the invention is to provide a carburetor which is controlled by a servo controller having sensors for speed and temperature of the engine, air temperature, atomospheric pressure, position and acceleration of accelerator pedal and brake pedal, the position of clutch and speed change gear, speed and load of the automobile, etc., and which can rapidly reply to driving operation and keeps the internal pressure of the carburetor the desired value.

The fifth object of the invention is to provide a reliable combustion system in which "lean burning" is carried on under usual driving condition, without stalling.

In carrying out the invention I provide a carburetor having a plurality of fuel-fed cells each of which has air flow control means which has only two sizes of air passageways therethrough, a manifold for combining the fuel-air outlets of the cells, and controller means which keeps the internal pressure of the manifold at a desired value by operating the air-flow control means of the cells.

An improvement on the basic invention just described is that said controller means comprises a pressure sensor in said manifold which provides pressure signals to a servo-controller which operates the air-flow means in the cells to keep the pressure in the manifold at a desired value. The servo-controller determines the desired value of pressure at which it reaches equilibrium. There are several engine operating conditions which may change the pressure which the servo-controller reaches equilibrium. Signals representing these operating conditions may be fed to the servo-controller to adjust the pressure that is to be selected. These operating conditions are enumerated in the "fourth object" which is set forth earlier in this specification.

A further inventive feature resides in the provision, in a carburetor having a multiplicity of cells, each cell having a valve to control the air flow therethrough, of just two operating positions of the valves. The amount of fuel-air mixture is increased by increasing the number of valves that are open. In the "closed" position, the valve may be (1) completely closed, or (2) almost closed (so that in the aggregate the aggregate flow through all of the valves will be adequate for idling), or (3) at least some of the valves will be partly open but still have a much smaller passageway than when the valve is "open". This aspect of the invention results in a "digital" control for the carburetor, namely each individual cell has only two operating states. The fuel to the engine is, therefore, increased only by progressively opening more valves, as distinguished from prior art arrangements where there is also a continuous progressive (analog) increase in the opening of each valve (even though they may be opened in series rather than in parallel).

In the preferred form the invention has a housing with the cells in the form of tubes entering the housing transversely to its side wall. The float-valve and liquid fuel chamber is located in the center of the housing. Each of the tubes is fed with fuel from said chamber and has its valve (with open and closed positions as aforesaid) therein. As an improvement the tubes may enter the housing at such an angle as to cause the fuel-air mixture to swirl inside the housing around the annular space between said liquid fuel chamber and the inner wall of the housing.

DETAILED DESCRIPTION OF PREFERRED EMBODIMENT

The carburetor in accordance with the invention is applied between an air filter and a throttle valve which is able to block an inlet of a combustion engine, and is connected to a fuel tank through a fuel pipe.

Figure 1:
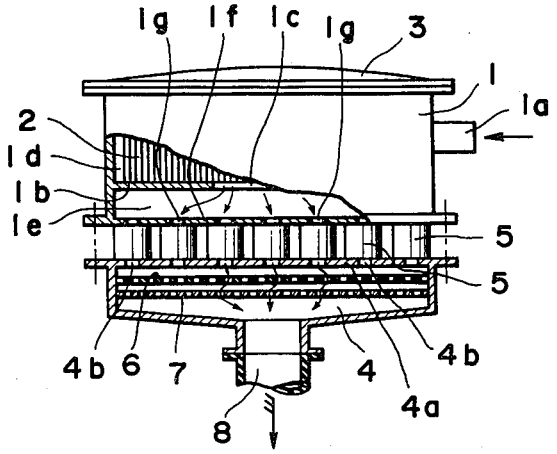
FIG. 1 is a side view, partly in section, of a carburetor constructed in accordance with one embodiment of the invention.

In FIG. 1, 1 is an air filter casing having an air inlet 1*a*, an inner partition 1*b* which has a center hole 1*c* and divides the inside of air filter casing 1 into two parts 1*d* and 1*e*, and a bottom plate 1*f* which has air paths 1*g*, 1*g*, 2 is an air filter element, 3 is a top cover, 4 is a manifold which is manifolding a lot of cell carburetors 5, 5, on its top board 4*a*, which has air paths 4*b*, 4*b*, 6 and 7 are baffle plates, 8 is an outlet pipe which is connected to an inlet of a combustion engine (not shown) through a throttle valve (not shown).

Figure 2:
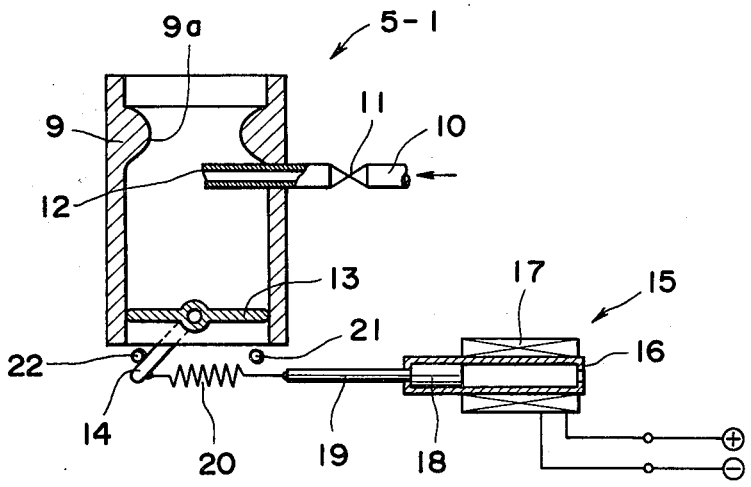
FIG. 2 is a sectional view of a cell carburetor which is completely closed.
Figure 3:
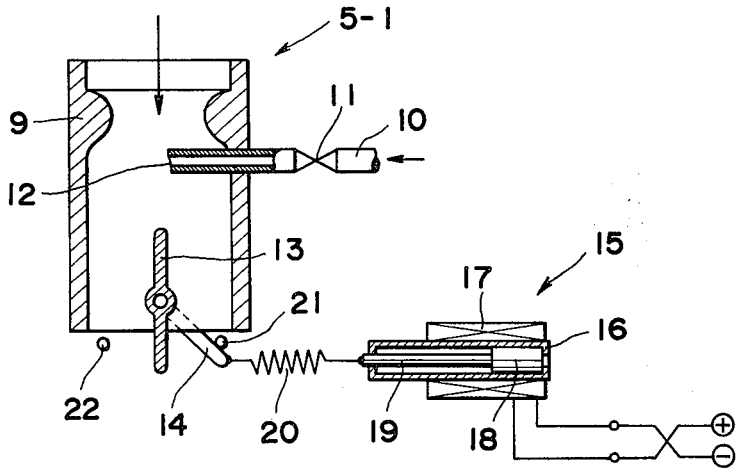
FIG. 3 is a view similar to FIG. 2, but illustrating a cell carburetor in the fully opened position.

The first embodiment of said cell carburetor is shown in FIGS. 2 and 3 as 5-1. In these drawings, 9 is a casing which has a throat 9*a*, 10 is a fuel pipe, 11 is a needle valve, 12 is a fuel injection nozzle, 13 is a flap valve, 14 is a switching lever of the flap valve 13, 15 is a solenoid which is constructed by a casing 16, a coil 17, a bar magnet 18 and a connecting rod 19, 20 is a spring and 21 and 22 are stopping pins.

These call carburetors are not used in the intermidiate opening condition between 0 and 100% opening, and FIG. 2 shows the cell carburetor 5-1 which is closed completely, and FIG. 3 full opened.

The position of the magnet 18 is changed in accordance with the direction of electric current in the coil 17 (the switch is not shown), and the opening of the flap valve 13 is also changed.

Figure 4:
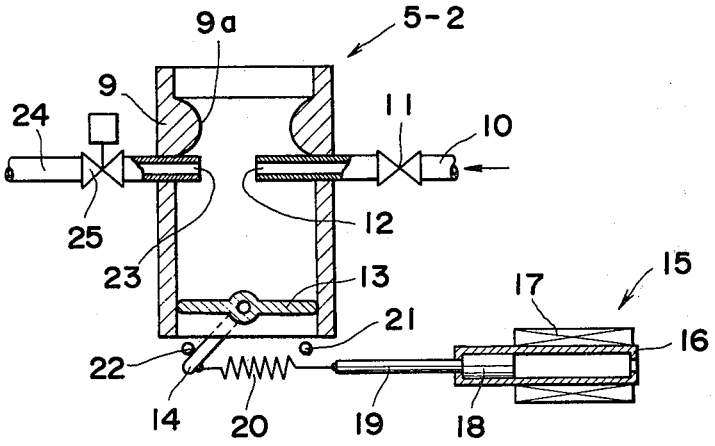
FIG. 4 is a sectional view of another cell carburetor which is completely closed.
Figure 5:
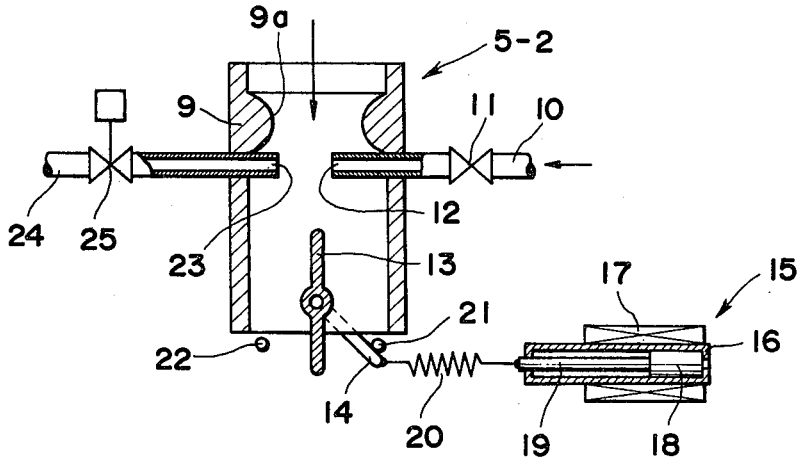
FIG. 5 is a view similar to FIG. 4, but illustrating a cell carburetor in the fully opened position.

The second embodiment of the cell carburetor is shown in FIGS. 4 and 5 as 5-2. This cell carburetor 5-2 is similar to the cell carburetor 5-1, but has an associate fuel injection nozzle 23 which is connected to a fuel pipe 24 through a solenoid valve 25.

The solenoid valve 25 is usually closed, but when the combustion engine needs the rich mixture, said solenoid valve 25 is opened, therefore, the ratio of air to fuel is decreased some fixed amount.

Figure 6:
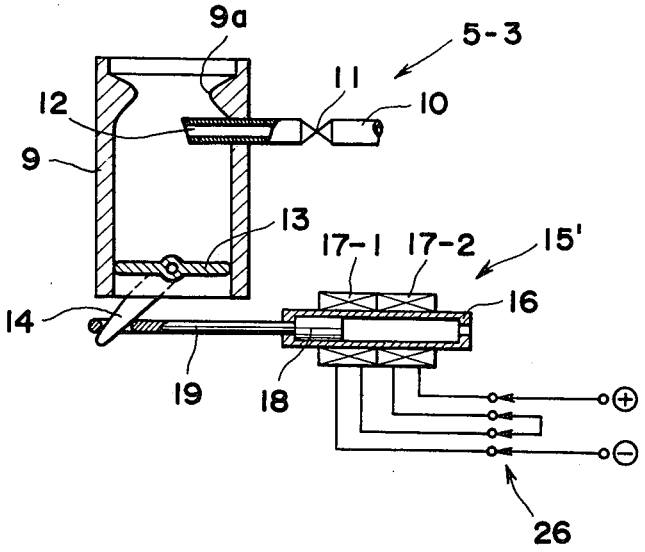
FIG. 6 is a sectional view of another cell carburetor which is completely closed.
Figure 7:
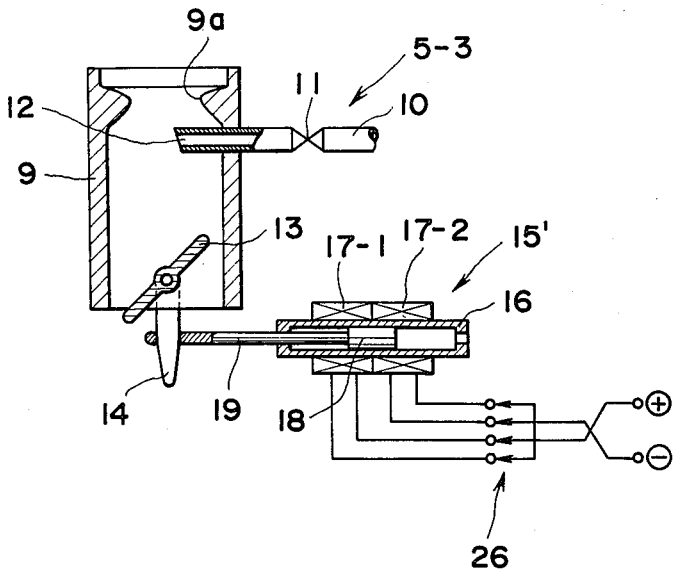
FIG. 7 is a view similar to FIG. 6, but illustrating a half-opened cell carburetor which is in one of its operating condition.
Figure 8:
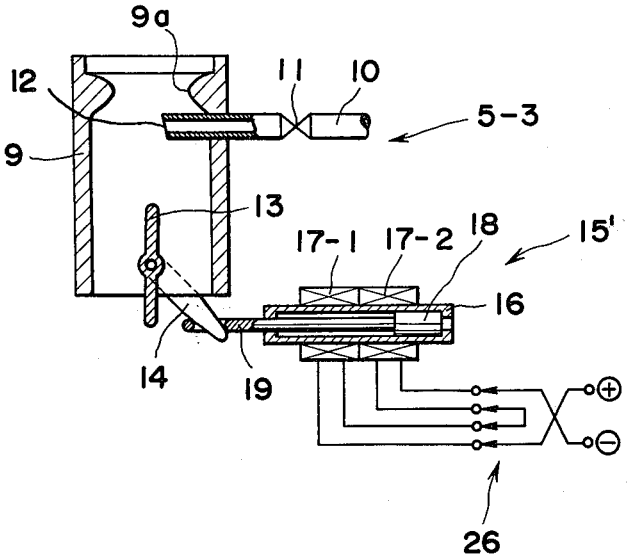
FIG. 8 is a view similar to FIGS. 6 and 7, but illustrating the cell carburetor in its fully opened operating condition.

The third embodiment of the cell carburetor is shown in FIGS. 6, 7 and 8, as 5-3. This cell carburetor 5-3 is very similar to the cell carburetor 5-1, but is controlled by a solenoid 15' which has two coils 17-1 and 17-2 and four way three position switch 26.

Therefore the cell carburetor 5-3 is used in two different working positions which are shown in FIGS. 7 and 8.

When the cell carburetor 5-3 is in the working position which is shown in FIG. 7, it supplies a mixture which is leaner and far less than the mixture which is supplied by the fully opened cell carburetor of FIG. 8.

Some of the cell carburetors 5-3 are usually kept in the working position which is shown in FIG. 7, and others are completely closed, but when the combustion engine needs a more enormous volume of rich mixture, all or some of the cell carburetors 5-3 are fully opened.

Figure 9:
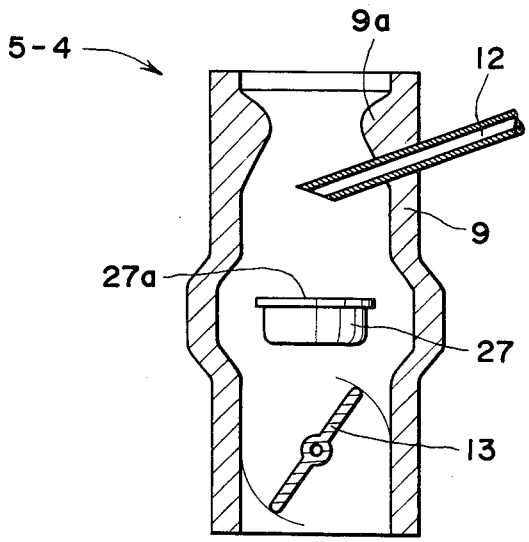
FIG. 9 is a sectional view of another cell carburetor.

The fourth embodiment of the cell carburetor is shown in FIG. 9 as 5-4, and 27 is an ultrasonic generator having a vibrating plate 27*a* which breaks large drops of fuel into a fine spray or mist.

Figure 10:
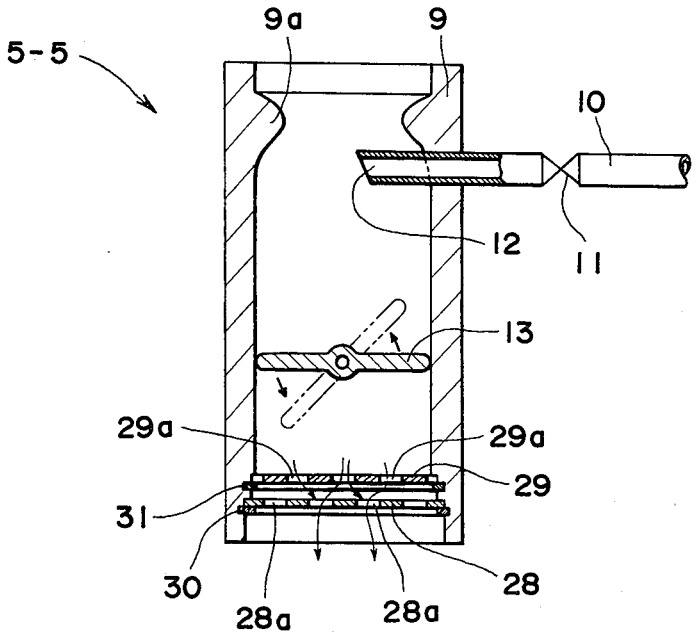
FIG. 10 is a sectional plan of another cell carburetor.

The fifth embodiment of the cell carburetor is shown in FIG. 10 as 5-5, and in FIG. 10, 28 and 29 are baffle plates which have a lot of small holes 28*a*, 28*a* and 29*a*, 29*a*, and 30 and 31 are retaining rings.

The baffle plates 28 and 29 catch the big drops of fuel and break them into a fine spray or mist.

These cell carburetors 5-4 and 5-5 are used in the same manner as the cell carburetor 5-1 or 5-3 is used.

Figure 16:
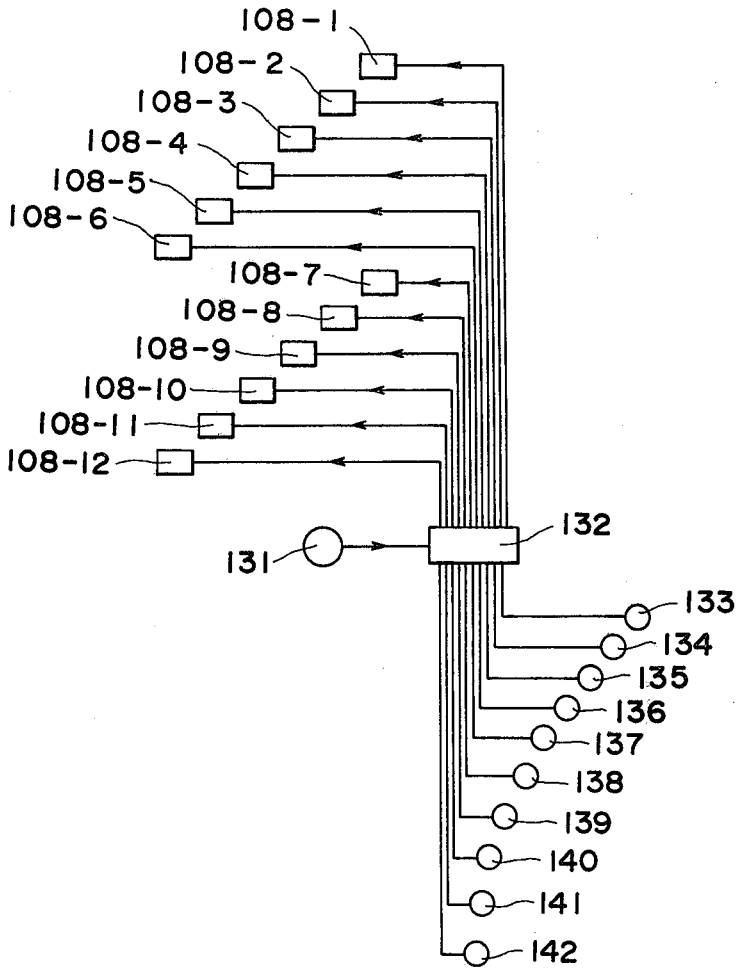
FIG. 16 is a circuit diagram for said carburetors.

All of the above described types of cell carburetors are used for the same purpose, and are adjusted to be able to supply the mixture gas having the ratio of air to fuel which is fixed with precision in anticipation, and controlled by a servo controller as shown in the FIG. 16.

Figure 11:
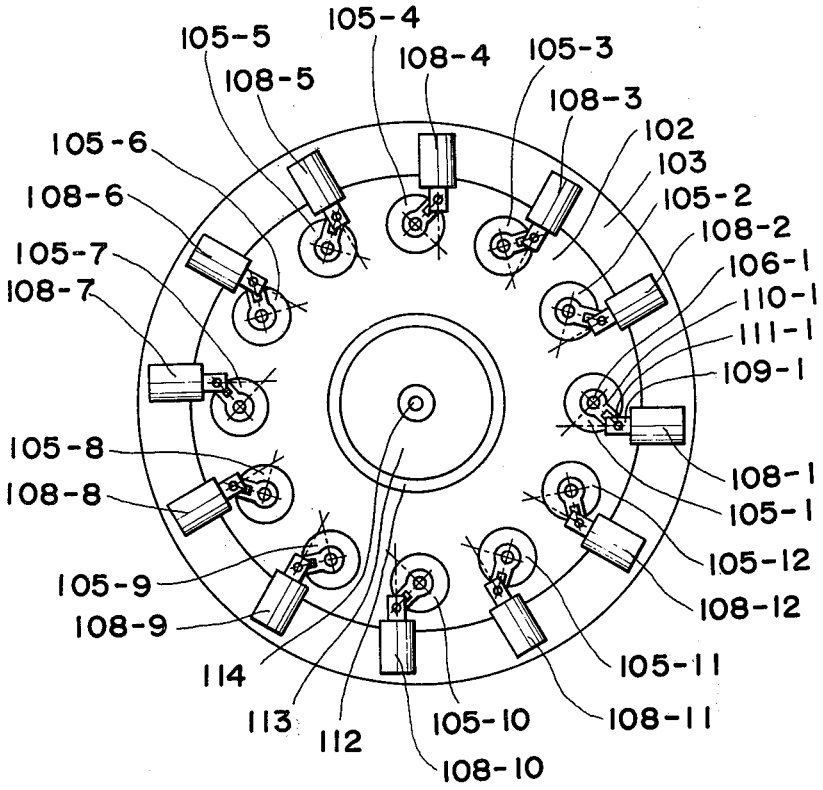
FIG. 11 is a top plan of another carburetor constructed in accordance with another embodiment of the invention.
Figure 12:
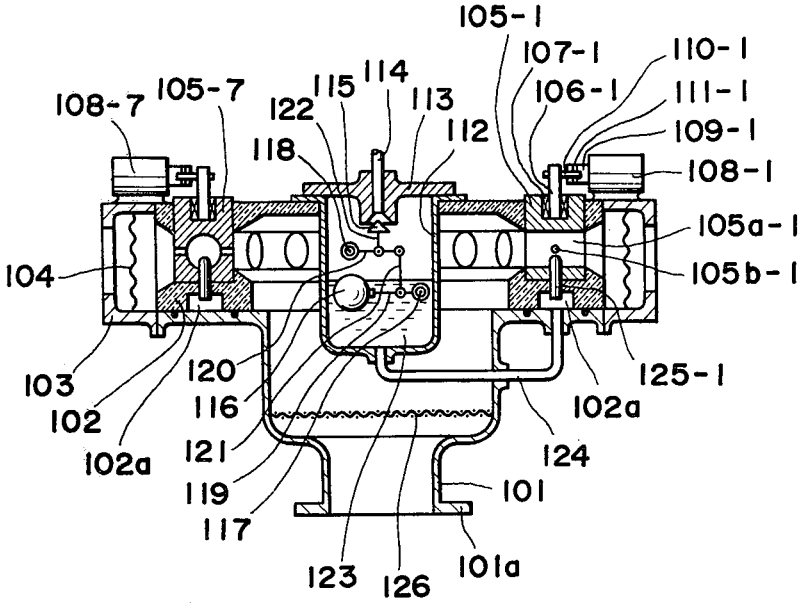
FIG. 12 is a drawing in vertical section of the carburetor which is shown in FIG. 11.
Figure 13:
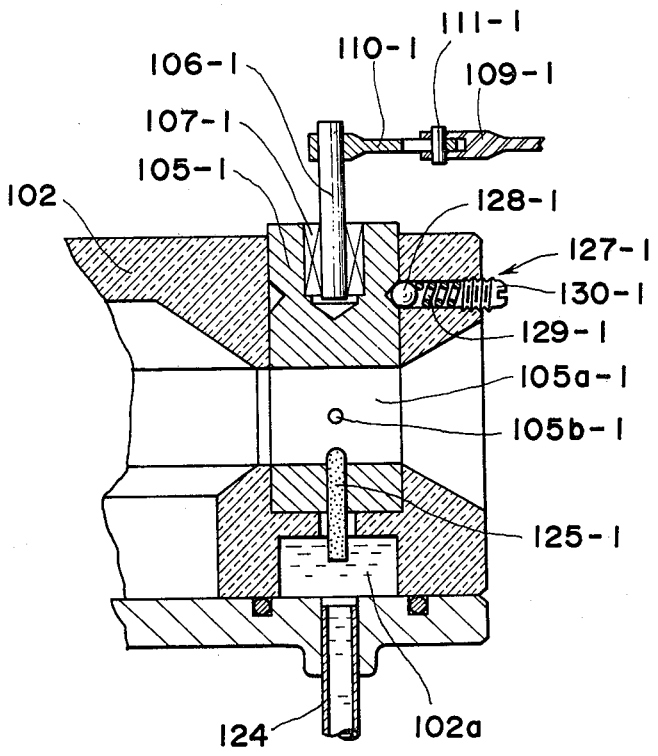
FIG. 13 is a magnified drawing of a cell carburetor which is shown in FIG. 12.

The second embodiment of the carburetor is shown in FIGS. 11, 12 and 13.

In these Figures, 101 is a base element, 102 is a retainer, 103 is an air filter casing, 104 is an air filter element, 105-1, 105-2, . . . and 105-12 are cell carburetors, 106-1, 106-2, . . . and 106-12 are driving shafts, 107-1, 107-2, . . . and 107-12 are one way clutches, 108-1, 108-2, . . . and 108-12 are solenoids, 109-1, 109-2, . . . and 109-12 are stems of the solenoids, 110-1, 110-2, . . . and 110-12 are connecting levers, 111-1, 111-2, . . . 111-12 are connecting pins, 112 is a float chamber, 113 is a top board, 114 is a fuel pipe, 115 is a valve, 116 is a float, 117 and 118 are fixed hinges, 119 is a float rod, 120 and 121 are valve links, 122 a valve rod, 123 is gasoline, 124 is a fuel supply pipe, 125-1, 125-2, . . . 125-12 are wicks, 126 is a fine wire gauze, 127-1 is a locating gear which consists of a small ball 128-1, a spring 129-1, and a setscrew 130-1.

This carburetor is made up of one dozen of the cell carburetors 105-*i* (i stands for 1, 2, . . . and 12), which are annularly mounted in the retainer 102.

The base element 101 has a large central cavity that receives the fuel-air mixture from the cell carburetors and hence base element 101 constitutes an output manifold. It has a flange 101*a* which is connected to a flange of a throttle valve (not shown) which is able to block an inlet of combustion engine, and the base element 101 supports the retainer 102 and all of the remaining parts of FIG. 12.

Every cell carburetor 105-*i* is similar to a cock, and is turned by an impulse movement of each solenoid 108-*i* through the driving shaft 106-*i* and one way clutch 107-*i*.

In concrete terms, when an electric pulse is given to the solenoid 108-*i*, the corresponding cell carburetor is turned just 90°.

And every cell carburetor 105-*i* has a main air path 105*a–i*, and all or some of them have their assistant air paths 105*b–i*, respectively.

And retainer 102 has a fuel distributing annular groove 102*a*, and the wicks 125-*i* are fixed into the holes through the upper wall of said fuel distributing annular groove 102*a*.

The wicks 125-*i* are made of a sintered porous bar or a bundle of elongated elements having capillary action, and the wicks 125-*i* deliver the fuel from said fuel distributing annular groove 102*a* into the main air paths 105*a–i* of the cell carburetors 105-*i* by their capillary action.

When the engine is started for warming up, the needed air and fuel are supplied through the assistant air paths 105*b–i*, but when full power is required, for example for quick starting, all main air paths 105*a–l* are full opened, and during constant speed driving, the needed number of the main air paths 105*a–i* which is determined by below-mentioned servo controller, in other words, by the engine load, are kept full opening, but the other main air paths 105*a–i* are closed.

Figure 14:
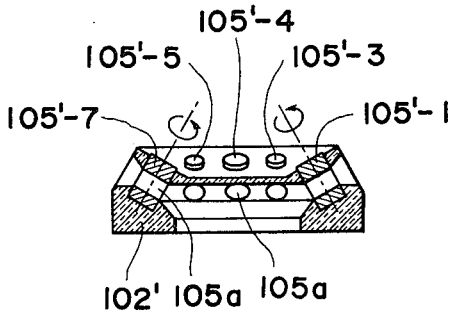
FIGS. 14 and 15 illustrate two other modified forms for the cell carburetors.
Figure 15:
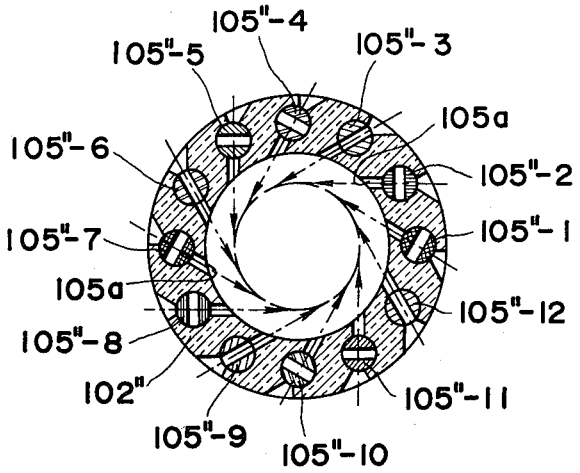

FIGS. 14 and 15 show modifications of the cell carburetors. In the FIG. 14, the cell carburetors 105'-*i* are placed on a common circular cone and in the FIG. 15, the cell carburetors 105''-*i* are placed in a mode in which they are able to induce a large swirl of the mixture in the carburetor.

And the carburetors which are shown in either of FIGS. 1 and 11 are controlled by a control system which is shown in FIG. 16 or like.

In the FIG. 16, 131 is a pressure sensor of internal pressure of the carburetor, 132 is a servo controller, 133 is a pressure sensor of inlet pressure of the combustion engine, 134 is an atomospheric pressure sensor, 135 is an air temperature sensor, 136 is an engine speed sensor, 137 is a temperature sensor, 138 is a sensor of position or acceleration of accelerator pedal, 139 is a sensor of position or acceleration of brake pedal, 140 is a sensor of position of speed change gear, 141 is a sensor of position of clutch and 142 is a sensor of car speed.

All cell carburetors are controlled by the servo controller 132 to keep the internal pressure constant.

For example, during idling or warming up, the throttle valve is almost shut and the engine is not in need of so much fuel, therefore, the main air paths of all cell carburetors are closed, but during acceleration in full power, all or a large majority of cell carburetors are fully open. And during constant speed driving, the required number of cell carburetors are fully open.

The servo controller 132 is not only controlling the internal pressure of the carburetor, also controlling the ratio of air to fuel of the mixture to adapt to engine condition and has to respond to the change of driving condition quickly.

The combustion engine insists on rich burning, when it is running under the following conditions;

1. under the low temperature.
2. under the low atomospheric pressure.
3. full power running, for example, acceleration, heavy load running, climbing, etc.

And rich burning is of advantage to power efficiency, but has an injurious effect on the physical environment and fuel consumption.

On the other hand, the combustion engine is not in need of rich burning, when it is running under the following conditions;

1. constant load and speed driving.
2. idling or warming-up.
3. slow acceleration.
4. under the high temperature.
5. under the high atomospheric pressure.

The regulations concerning harmful exhaust gases have been made more rigorous recently. Therefore, the said servo controller 132 for the carburetor which is used for an automobile is not only able to control the internal pressure of the carburetor but, also must make a good selection of the ratio of air to fuel.

For this reason, the cell carburetor 5-2 which is shown in FIGS. 4 and 5 or the cell carburetor 5-3 which is shown in FIGS. 6, 7 and 8 is used, otherwise some groups of the cell carburetors which are given some different value of ratio of air to fuel group by group are used.

When the carburetor which is made up of the cell carburetors 5-2 is used, the servo controller 132 opens the needed number of cell carburetors to its full width to keep the internal pressure of the carburetor to the desired value, independently of the opening of throttle valve, and also controls the solenoid valve 25 to adjust the ratio of air to fuel to the desired value.

When the carburetor consists of the cell carburetors 5-3, the servo controller 132 makes a good choice of the combination of number and opening of cell carburetors to supply the needed volume of mixture gas which has the ratio of air to fuel which lets the existing operating conditions.

In this case (FIGS. 7 and 8) each cell carburetor has a different flow rate and also a different ratio of air to fuel between full opening and half opening.

The following symbols apply to those cells of carburebor 5-3 which have their flap valve 13 (FIG. 8) wide open, that is in full opening condition:

Q; weight flow rate of mixture,

R; weight ratio air/fuel,

Similarly the following symbols apply to the cells of carburetor 5-3 which have their flap valve half open (FIG. 7), that is in half opening condition,

*q;* weight flow rate of mixture, and,

*r;* weight ratio air/fuel,

N; number of full opened cell carburetors,

*n;* number of half opened cell carburetors,

Then, the total flow rate of mixture is given by the formula ($NQ+nq$), and the effective ratio of air to fuel is given by the formula $$\frac{NQr(R-1)+nqR(r-1)}{NQr+nqR}.$$

Some embodiments concerning the carburetor which are shown in FIGS. 11 and 12 are shown as follows:

Embodiment I, II and III: :

1. Number of cells in the carburetor; 20.
2. Ratio of air to fuel: see table I.

TABLE I

| Cell Carburetor | | Ratio Air/Fuel | | |
|---|---|---|---|---|
| | | Main Air Path Embodiment | Assistant Air Path Embodiment | |
| Group | Serial No. | I, II and III | I and II | III |
| 1 | 1, 2, 3, 4, 5, 6, | 16.5 | — | 17.5 |
| 2 | 7, 8, 9, 10, 11, 12, | 17.5 | — | 17.5 |
| 3 | 13, 14, 15, 16, 17, 18, | 18.5 | — | 17.5 |
| 4 | 19 | 13.0 | — | 17.5 |
| 5 | 20 | 12.0 | — | 17.5 |

3. Relative ratio of mixture flow: See Table II

TABLE II

| Cell Carburetor Serial No. | Relative Ratio of Mixture Flow | | | | |
|---|---|---|---|---|---|
| | Main Air Path Embodiment | | | Assistant Air Path Embodiment | |
| | I | II | III | I and II | III |
| 1, 7, 13, | 1.0 | 1.00 | 1.5 | 0 | 0.075 |
| 2, 8, 14, | 1.2 | 1.15 | 1.5 | 0 | 0.075 |
| 3, 9, 15, | 1.4 | 1.32 | 1.5 | 0 | 0.075 |
| 4, 10, 16, | 1.6 | 1.52 | 1.5 | 0 | 0.075 |
| 5, 11, 17, | 1.8 | 1.75 | 1.5 | 0 | 0.075 |
| 6, 12, 18, | 2.0 | 2.0 | 1.5 | 0 | 0.075 |
| 19 | 1.0 | 1.0 | 1.5 | 0 | 0.075 |
| 20 | 1.5 | 1.5 | 1.5 | 0 | 0.075 |

In these embodiments, the cell carburetors are divided into five groups, and the mixture through the main air paths of the group 1, 2 and 3 cell carburetors have the value of 16.5, 17.5 and 18.5 as the ratio of air to fuel respectively.

And in the Embodiment I, no cell carburetor has its assistant air path, and the cell carburetors which are included in each group are given flow rates which increase in arithmetic progression respectively.

Therefore any group of cell carburetors is able to serve the combustion engine with the mixture gas flow which is variable 0.2 by 0.2 in the flow range from 1 to 9.

In the Embodiment II, also no cell carburetor has its assistant air path, and the cell carburetors which are included in each group are given flow rates which increase in geometric progression.

Therefore, the flow rate of mixture is controlled more minutely and precisely.

In embodiments I and II, during the idling or warming-up, the needed air and fuel are supplied by only one of the cell carburetors, usually No. 13, but in the cool seasons or region, No. 7 or No. 1 is used in place of No. 13.

In the Embodiment III, all cell carburetors have an assistant air path, and the same flow rate, but the value of their ratios of air to fuel of the mixture through their main air paths are different from group to group.

Therfore, any group of the cell carburetors is able to supply the mixture gas flow which is variable 1.425 by 1.425 in the flow range from 1.5 to 9.

And during idling or warming-up, needed air and fuel are supplied through the assistant air paths of all cell carburetors, and the sum total of flow is equal to a flow rate which is through one main air path.

But, when the air temperature is lower than the standard temperature the cell carburetor No. 19 is opened additionally and when the air temperature is still lower the cell carburetor No, 20 is opened in place of No. 19.

In the Embodiments I, II and III, when a rapid starting is carried out and full power is required, all cell carburetors are full opened quickly but in regular order, according to the pre-determined programme, thereafter, the cell carburetors, excepting the needed number of them, are orderly closed, while the acceleration decreases from its maximum value to zero (car speed comes up to the desired constant value).

And in these cases, the throttle valve which is mounted between the carburetor and the combustion engine is operated by the driver through the acceleration pedal.

When the opening of throttle valve is increased, a sharp fall happens in the internal pressure of carburetor, this pressure drop is detected by sensor 131, and the servo controller 132 issues one or a few signal pulses in order to open fully the cell carburetors concerned which are still shut until this time.

This action goes on until the internal pressure of the carburetor gets back to the desired value.

As the opening of the throttle valve is decreased, the internal pressure assumes an upward curve, in which event some cell carburetors are shut by the signal pulses from the servo controller 132.

As above-mentioned, the servo controller 132 determines the number of cell carburetors which should be opened to keep the internal pressure of carburetor to said desired value, and also,, the servo controller 132 selects the group of the cell carburetors which should be used under existing conditions, according to the signals from the sensors 133, 134, 135, 136 and etc.

The inlet pressure of the combustion engine and engine power are linear with each other, then the output signal from the pressure sensor 133 is able to be used as a parameter of engine power.

And the output signals from the sensors 137, 138, 139, 140, 141, and 142 contribute to the quick and smooth action of the servo controller 132.

For example, some of them are used to feed forward control, and other are used to change the proportional gain, the integral time, the derivation time or/and the desired value of the servo system.

The number and capacity of the cell carburetors of which the carburetor is made should be designed with due consideration of the type and capacity of the combustion engine.

Usualy for a large capacity engine, for example, 12,000–5,000 cc. engine, it is recommended to use a carburetor which is constructed with about 40–20 cell carburetors, for a middle size engine, 5,000–2,000 cc. engine, with about 30–10 cell carburetors, and for a small engine, 2,000–500 cc. engine with 15-5 cell carburetors.

And, when the cell carburetors of Embodiment I or II, are adopted, a small number of cell carburetors, which have relatively big capacity, should be used.

In the carburetor which is used for a lean burning type engine, or small size engine, the cell carburetors have less groups than in the case of a full size engine.

And also it is recommended that a wire gauze, a perforated disc or an ultrasonic generator in the mixture path of the carburetor cell, be employed in order to break big drops of fuel into finely atomized fog.

And also it is recommended to prepare an accumulator in the carburetor, in order to supply the mixture smoothly to the combustion engine.

The carburetor concerning this invention consists of many cell carburetors, and each of them is preferably only used in either full opening (or a specific opening) or substantially closed.

Therefore both the flow rate of mixture and the ratio of air to fuel of mixture are exactly controlled.

In this carburetor, fuel is supplied through plural small sources, and therefore, the supplied fuel is finely atomized.

Therefore, the combustion engine which is supplied air and fuel by this carburetor is able to run with a lean mixture, and without harmful exhaust.

What I claim is:

1. A carburetor comprising a plurality of cell carburetors, each cell carburetor having a conduit with an air inlet at one end, a fuel-air outlet at the other end, means for supplying fuel to the air flowing through the conduit, and airflow control means for providing only two sizes of air passageways through the conduit, manifold means for combining the fuel-air mixtures from said outlets, and controller means which keeps the internal pressure of said manifold means at a desired value, said controller means including means for controlling said pressure by operating said air-flow control means of the cells to provide the desired pressure.

2. A carburetor according to claim 1, wherein a casing element in which said cell carburetors are retained is provided, and said casing element is a disklike or ringlike element which is connectable to a combustion engine, and a float chamber through which needed fuel is supplied is mounted on the main axis of said casing element.

3. A carburetor according to claim 2, wherein every one of said cell carburetor includes a cocklike cylindrical element which is able to block an air path penetrating said casing element and the cell carburetor, said casing element having a fuel distributing annular groove, and wicks which penetrate through said casing element wall and carry fuel from said fuel distributing annular groove to the air paths of said cell carburetors.

4. A carburetor according to claim 3, wherein said cell carburetors are placed in a mode in which their axes of the air paths are inclined with respect to the main axis of the carburetor and placed on a common circular cone.

5. A carburetor according to claim 3, wherein said cell carburettors are placed in a mode in which they are able to induce a large swirl of the mixture in the carburetor.

6. A carburetor according to claim 3, wherein each one of said cocklike cylindrical elements is rotated by a solenoid, which is driven by electric pulses which are outputted by said controller means through a one way clutch 45° or 90° in response to a stroke of said solenoid in the one direction.

7. A carburetor according to claim 3, wherein said wicks comprise a sintered porous bars which are able to deliver fuel from said fuel distributing annular groove into said air paths of said cell carburetors by their capillary action.

8. A carburetor according to claim 1, wherein every one of said cell carburetors includes a Venturi-tubelike casing having a portion of restricted cross-section to form the venturi, a fuel injection nozzle immediately downstream of said restricted cross-section and a flap valve.

9. A carburetor according to claim 1, wherein every one of said cell carburetors consists of a Venturi-tubelike casing, a main fuel injection nozzle, an assistant fuel injection nozzle and a flap valve, said venturi-tubelike casing having a restricted cross-section and said nozzles being immediately downstream of said restricted cross-section.

10. A carburetor according to claim 1, wherein every one of said cell carburetors is set up to be able to supply an engine with mixture whose ratio of air to fuel is fixed, when said air flow means provides the cell carburetor with the larger of its two sizes of air passageways.

11. A carburetor according to claim 1, wherein the flow rates of mixture of at least some of said cell carburetors are equal with one another.

12. A carburetor according to claim 1, wherein the flow rates of mixture of at least some of said cell carburetors are increased in arithmetic progression.

13. A carburetor according to claim 1, wherein the flow rate of mixture of all or some of said cell carburetors are increased in geometric progression.

14. A carburetor according to claim 1, wherein the opening of said cell carburetors are controlled by said controller means which comprises: a servo controller which selects the combination of said cell carburetors to keep the internal pressure of the carburetors at a desired value, and in response to the changes in the driving conditions.

15. A carburetor according to claim 1, wherein means for breaking up the fuel and vaporizing it is provided across the outlet of a carburetor cell.

16. A carburetor according to claim 1, wherein an ultrasonic generator is provided in the outlet of a carburetor cell.

17. A carburetor for an internal combustion engine comprising a multiplicity of cells, each of said cells comprising a conduit having an air inlet and a fuel-air mixture outlet, a fuel supply device for supplying fuel to each cell in relation to the air flow through the cell, air flow control means for separately controlling the air flow through some of the cells, in which the air flow means for each cell has a substantially closed position and only one open position, means for holding said air flow means of each cell in its substantially closed position but changing a progressively larger number of the air flow means of the cells to their open positions as the demand for the quantity of the fuel-air mixture at the output of said manifold increases, and a housing surrounding the fuel-air mixture outlets of the cells to combine the fuel-air mixtures of the conduits and provide a common outlet therefor.

18. A carburetor as defined in claim 1 in which the cells have the air paths therethrough substantially straight and parallel to each other, a housing surrounding said cells and feeding air to the air inlets of each cell, and said manifold means of the carburetor having its air path parallel to the air flow paths through said cells.

19. A carburetor as defined in claim 18 in which said housing extends upstreamwardly of the air inlets of the cells, a filter in said housing upstream of said cells, said filter having a downstream side adjacent the air inlets of the cells.

20. A carburetor as defined in claim 1 in which said housing has a side wall surrounding said cells, and also has a central chamber, said cells each being located in said side wall with the outlet ends of the cells feeding said chamber and the inlets of said cells receiving air from outside the housing.

21. A carburetor for an internal combustion engine comprising a multiplicity of cells, each of said cells comprising a conduit having an air inlet and a fuel-air mixture outlet, a fuel supply device for supplying fuel to each cell in relation to the air flow through the cell, air flow control means for separately controlling the air flow through some of the cells, in which the air flow control means for each cell has only two positions, one of which is an open position and the other of which is a substantially closed position, said air flow control means including means for controlling the air flow through the carburetor by varying the number of cells whose air flow control means is open, and a housing surrounding the fuel-air mixture outlets of the cells to combine the fuel-air mixtures of the conduits and provide a common outlet therefor.

22. A carburetor as defined in claim 1 in which the cells have the air paths therethrough substantially straight and parallel to each other, a housing surrounding said cells and feeding air to the air inlets of each cell, and an outlet for the carburetor having its air path parallel to the air flow paths through said cells.

23. A carburetor as defined in claim 22 in which said housing extends upstreamwardly of the air inlets of the cells, a filter in said housing upstream of said cells, said filter having a downstream side adjacent the air inlets of the cells.

24. A carburetor as defined in claim 21 in which said housing has a side wall surrounding said cells, and also has a central chamber, said chamber and said common outlet communicating with each other to form a single open space, said cells each being located in said side wall with the outlet ends of the cells feeding said chamber and the inlets of said cells receiving air from outside the housing.

25. A carburetor comprising a multiplicity of cell carburetors each characterized by a tubular element open at each of its two ends, one of said open ends comprising an air inlet and the other open end comprising a fuel-air outlet, fuel supply means for supplying fuel to said tubular elements intermediate their two ends, valve means, in each tubular element, downstream the fuel supply means for opening and closing the passageway through the tubular element, each said valve means having a substantially closed position and only one open position, and a manifold for combining the fuel-air outlets of said tubular elements.

26. A carburetor comprising a multiplicity of cell carburetors each characterized by a tubular element open at each of its two ends, one of said open ends comprising an air inlet and the other open end comprising a fuel-air outlet, fuel supply means for supplying fuel to said tubular elements intermediate their two ends, valve means, in each tubular element, downstream the fuel supply means for opening and closing the passageway through the tubular element, and a manifold for combining the fuel-air outlets of said tubular elements, each said valve means having a closed position and only one open position, and motor means for selectively actuating said valve means to either of its positions.

27. A carburetor comprising a multiplicity of cell carburetors each characterized by a tubular element open at each of its two ends, one of said open ends comprising an air inlet and the other open end comprising a fuel-air outlet, fueld supply means for supplying fuel to said tubular elements intermediate their two ends, separate valve means, for each of at least some of said tubular elements, for opening and closing the passageway through the tubular element, each said valve means being operable independently of the others and having only two different control positions, and a manifold for combining the fuel-air outlets of said tubular elements.

28. A carburetor comprising a multiplicity of cell carburetors each characterized by a tubular element open at each of its two ends, one of said open ends comprising an air inlet and the other open end comprising a fuel-air outlet, fuel supply means for supplying fuel to said tubular elements intermediate their two ends, and separate valve means, for each of at least some of said tubular elements, for opening and closing the passageway through the tubular element, each said valve means having only two operating positions, and motor means for selectively actuating each said valve means to either of its positions.

29. A carburetor as defined in claim 1 in which said controller means includes (a) pressure sensing means in said manifold and (b) means responsive to the amount of pressure sensed by said pressure sensing means for controlling said pressure by operating said air-flow control means of the cells to provide the desired pressure.

30. A carburetor as defined in claim 21:

said housing defining a central cavity, said conduits extending transversely through the housing to provide air-inlets into the conduits from the atmosphere outside the housing and fuel-air outlets from the conduits for feeding said cavity, said fuel supply device including a liquid fuel supply chamber in said cavity, said air flow control means including, for at least some of said conduits, a valve for controlling the air flow through the conduit.

31. A carburetor as defined in claim 30 in which said control means providing for increasing and decreasing the amount of fuel-air at the outlet of the housing by increasing and decreasing the number of said valves that are opened by said control means.

32. A carburetor as defined in claim 31 in which said control means sequentially opens and increasing number of said valves to increase the amount of fuel-air mixture at the outlet of said housing.

33. A carburetor as defined in claim 30 in which said chamber has means, comprising a float and valve, for regulating the level of the liquid fuel in said chamber.

34. A carburetor as defined in claim 33 in which said conduits are at a slightly higher level than said float, said fuel supply means including a fuel channel connecting said chamber to the conduits including means for delivering the fuel from the channel to the conduits so that the rate at which fuel is delivered to any given conduit varies with the rate of air flow through that conduit.

35. A carburetor as defined in claim 34 in which said last-named means is a capillary element.

36. A carburetor as defined in claim 30 in which each valve includes a cock, each cock comprising a cylindrical element which has at least one transverse hole therethrough, said cock being positioned in its complementary conduit so that the rotation of the cylindrical element about its axis varies the size of the passageway through the conduit.

37. A carburetor as defined in claim 36 in which each cylindrical element has two transverse holes therethrough one of which is much larger than the other to thus provide two different rates of flow for two different positions of the cylindrical element.

38. A carburetor as defined in claim 30 in which said housing has a vertical center-line and in which the conduits direct their fuel-air outlet mixture in a direction to create a flow of that mixture adjacent to the inner wall of the housing, to create a flow generally concentric with the vertical centerline of the housing, each conduit directing its output in the same angular direction around said center-line to thus create a swirl of the mixture around the housing adjacent its inner wall.

39. A carburetor as defined in claim 38 in which said liquid fuel supply chamber is located along said centerline so that said swirl occurs between said chamber and the inner wall of said housing.

40. A carburetor as defined in claim 1 including additional means for varying the pressure which the controller means holds in the manifold means according to an engine operating condition.

41. A carburetor as defined in claim 40 in which said engine operating condition is engine inlet pressure.

42. A carburetor as defined in claim 40 in which said engine operating condition is atmospheric pressure.

43. A carburetor as defined in claim 40 in which said engine operating condition is air temperature.

44. A carburetor as defined in claim 40 in which said engine operating condition is engine speed.

45. A carburetor as defined in claim 40 for an automobile having an accelerator pedal in which said engine operating condition is the position of the accelerator pedal.

46. A carburetor as defined in claim 40 for an automobile in which said engine operating condition is automobile speed.

47. A carburetor as defined in claim 40 for an automobile having a speed change gear in which said engine operating condition is the position of the speed change gear.

48. A carburetor as defined in claim 40 for an automobile having a clutch in which said engine operating condition is the position of the clutch.

49. A carburetor as defined in claim 40, for an automobile having a brake pedal, in which said engine operating condition comprises the position of the brake pedal.

50. A carburetor as defined in claim 1 in which one of said two sizes of passageways is zero.

51. A carburetor as defined in claim 1 in which the aggregate fuel flow through all of the smaller size of passageways provides sufficient fuel for idling.

52. A carburetor as defined in claim 1 in which said two sizes includes (1) a substantially closed position and (2) an open position; the sizes of at least some of the conduits in their open positions differing in size, said controller means opening the conduits in a prescribed order when it is desired to increase the amount of the fuel-air mixture passing through said manifold means.

53. A carburetor as defined in claim 1 in which said one of said two sizes is an at least partially open position, at least some of said conduits including means to provide them with different fuel-air ratios in their open positions, said controller means opening said conduits in a prescribed order when it is desired to increase the amount of fuel-air mixture from the carburetor.

54. A carburetor as defined in claim 1 in which the first-named means includes two fuel nozzles entering the conduit and means for feeding fuel through said nozzles.

* * * * *